US011685629B2

(12) United States Patent
Bearden

(10) Patent No.: US 11,685,629 B2
(45) Date of Patent: Jun. 27, 2023

(54) REEL CHOCK

(71) Applicant: Southwire Company, LLC, Carrollton, GA (US)

(72) Inventor: Roy Savoy Bearden, Temple, GA (US)

(73) Assignee: Southwire Company, LLC, Carrollton, GA (US)

( * ) Notice: Subject to any disclaimer, the term of this patent is extended or adjusted under 35 U.S.C. 154(b) by 0 days.

(21) Appl. No.: 17/208,116

(22) Filed: Mar. 22, 2021

(65) Prior Publication Data

US 2021/0206595 A1 Jul. 8, 2021

Related U.S. Application Data

(62) Division of application No. 15/678,833, filed on Aug. 16, 2017, now Pat. No. 10,954,097.

(51) Int. Cl.

| | |
|---|---|
| ***B65H 49/36*** | (2006.01) |
| ***B65H 75/14*** | (2006.01) |
| ***B65H 49/38*** | (2006.01) |

(52) U.S. Cl.

CPC ..... *B65H 49/36* (2013.01); *B65H 49/38* (2013.01); *B65H 75/14* (2013.01); *B65H 2701/537* (2013.01)

(58) Field of Classification Search

None

See application file for complete search history.

(56) References Cited

U.S. PATENT DOCUMENTS

| | | | | |
|---|---|---|---|---|
| 308,411 | A | 11/1884 | Harding et al. | |
| 465,281 | A | 12/1891 | Meyer | |
| 486,010 | A | 11/1892 | Wirt | |
| 613,138 | A | 10/1898 | Gempeler | |
| 709,932 | A | 9/1902 | Schooley | |
| 1,353,541 | A | 9/1920 | Retterer | |
| 1,376,114 | A * | 4/1921 | James | B60T 3/00 188/32 |
| 1,445,071 | A * | 2/1923 | Collins | B61K 7/20 104/258 |
| 1,461,939 | A | 7/1923 | Sager | |

(Continued)

FOREIGN PATENT DOCUMENTS

| | | |
|---|---|---|
| AT | 156245 B | 5/1939 |
| CN | 203922263 | 11/2014 |

(Continued)

OTHER PUBLICATIONS

U.S. Office Action dated Aug. 13, 2021 in U.S. Appl. No. 16/390,733.

(Continued)

*Primary Examiner* — William A. Rivera

(74) *Attorney, Agent, or Firm* — Hartman & Citrin LLC

(57) ABSTRACT

A reel chock is disclosed according to various embodiments. The reel chock can include a chock body that has a width that extends along a pivot axis. The reel chock also can include a pivot plate attached to the chock body. The pivot plate can be transverse to the pivot axis. The reel chock also can include a pivot arm that is rotatably connected to the pivot plate such that the pivot arm rotates about the pivot axis. The pivot arm can include a fastener portion that extends at least partially over the chock body.

19 Claims, 9 Drawing Sheets

(56) References Cited

U.S. PATENT DOCUMENTS

| | | | |
|---|---|---|---|
| 1,561,160 | A | 11/1925 | Ingenthron |
| 1,661,991 | A | 3/1928 | Benit |
| 1,726,137 | A | 8/1929 | Suarez et al. |
| 1,852,939 | A | 4/1932 | Schmidt |
| 1,858,825 | A | 5/1932 | Hescock |
| 1,949,378 | A | 2/1934 | Roehm |
| 1,961,376 | A | 6/1934 | McIlvried |
| 2,132,043 | A | 10/1938 | Oldham |
| 2,549,224 | A | 4/1951 | Moldovan |
| 2,553,835 | A | 5/1951 | Sachs |
| 2,707,599 | A | 5/1955 | Snyder |
| 2,720,285 | A | 10/1955 | Taylor |
| 2,960,857 | A | 11/1960 | Winter |
| 3,009,667 | A | 11/1961 | Browne |
| 3,152,772 | A | 10/1964 | Schjerven |
| 3,207,456 | A | 9/1965 | Hill |
| 3,298,667 | A | 1/1967 | Grantham et al. |
| 3,393,790 | A | 7/1968 | Dixon |
| 3,405,881 | A | 10/1968 | Sanford et al. |
| 3,450,366 | A | 6/1969 | Goldberg |
| 3,652,026 | A | 3/1972 | Awebro |
| 3,820,733 | A | 6/1974 | Roederer et al. |
| 3,822,841 | A | 7/1974 | Campbell |
| 3,850,382 | A | 11/1974 | Clingerman et al. |
| 3,860,193 | A | 1/1975 | Green |
| 3,976,260 | A | 8/1976 | Irik |
| 3,997,127 | A | 12/1976 | Kovaleski |
| 4,034,933 | A | 7/1977 | Hara et al. |
| 4,124,176 | A | 11/1978 | Carlson et al. |
| 4,126,211 | A | 11/1978 | Blosser |
| 4,164,131 | A | 8/1979 | Desmond |
| 4,176,801 | A | 12/1979 | Douglas |
| 4,183,475 | A | 1/1980 | Martija |
| D254,595 | S | 4/1980 | Hart |
| 4,226,383 | A | 10/1980 | Douglas |
| 4,232,837 | A | 11/1980 | Cutler et al. |
| 4,298,174 | A | 11/1981 | Kovaleski |
| 4,325,522 | A | 4/1982 | Sauber |
| 4,441,586 | A | 4/1984 | Bernier |
| 4,447,012 | A | 5/1984 | Woodruff |
| 4,605,237 | A | 8/1986 | Torgrimson |
| 4,649,724 | A | 3/1987 | Raine |
| 4,746,078 | A | 5/1988 | Setzke |
| 4,747,561 | A | 5/1988 | Sweeney et al. |
| 4,784,221 | A | 11/1988 | Share et al. |
| 4,819,462 | A | 4/1989 | Aspell |
| 4,833,442 | A | 5/1989 | Von Heck |
| 4,917,322 | A | 4/1990 | Combs |
| 4,948,064 | A | 8/1990 | Richard |
| 5,040,739 | A | 8/1991 | Wolf et al. |
| 5,054,745 | A | 10/1991 | Swayze et al. |
| 5,060,882 | A | 10/1991 | Rousculp et al. |
| 5,113,976 | A | 5/1992 | Noakes |
| D347,988 | S | 6/1994 | Thorne |
| 5,490,805 | A | 2/1996 | Bredesen |
| 5,498,940 | A | 3/1996 | Kim et al. |
| 5,628,212 | A | 5/1997 | Fritzler |
| D385,525 | S | 10/1997 | Beavers et al. |
| 5,752,670 | A | 5/1998 | Lasecki et al. |
| 5,862,688 | A | 1/1999 | Odegard |
| 6,073,470 | A | 6/2000 | Burnitzki |
| 6,105,604 | A | 8/2000 | Furness |
| 6,193,185 | B1 | 2/2001 | Kim |
| 6,299,100 | B1 | 10/2001 | Cloud |
| 6,305,409 | B1 | 10/2001 | Furness |
| 6,318,665 | B1 | 11/2001 | King |
| 6,435,450 | B1 | 8/2002 | Shields et al. |
| 6,978,960 | B2 | 12/2005 | Schaller |
| D513,975 | S | 1/2006 | Falconer |
| 6,997,022 | B1 | 2/2006 | DeMange |
| 7,594,771 | B2 | 9/2009 | Mindler |
| D613,231 | S | 4/2010 | Anderson et al. |
| 7,861,904 | B1 | 1/2011 | Taylor et al. |
| 7,874,511 | B2 | 1/2011 | Chiorgno et al. |
| 8,016,267 | B2 | 9/2011 | Jordan et al. |
| 8,245,965 | B2 | 8/2012 | Andrea et al. |
| 8,403,345 | B2 | 3/2013 | Iossa et al. |
| 8,444,078 | B1 | 5/2013 | Brown et al. |
| 8,602,341 | B2 | 12/2013 | Land |
| 8,616,485 | B2 | 12/2013 | Iossa |
| 8,662,803 | B2 | 3/2014 | Bowman |
| 9,004,392 | B1 | 4/2015 | Bigbee et al. |
| 9,016,607 | B2 | 4/2015 | Wong et al. |
| 9,403,659 | B2 | 8/2016 | Galindo Gonzalez et al. |
| 9,452,908 | B1 | 9/2016 | Bigbee et al. |
| 9,676,587 | B1 | 6/2017 | Bigbee et al. |
| 2007/0114039 | A1 | 5/2007 | Hobdy et al. |
| 2007/0181739 | A1 | 8/2007 | Derendal |
| 2007/0257146 | A1 | 11/2007 | Fleming |
| 2008/0048063 | A1 | 2/2008 | Wells et al. |
| 2009/0272838 | A1 | 11/2009 | Kaminaka |
| 2010/0044490 | A1 | 2/2010 | Fleming et al. |
| 2010/0230528 | A1 | 9/2010 | Singleton |
| 2011/0162916 | A1 | 7/2011 | Salinger et al. |
| 2012/0199683 | A1 | 8/2012 | Cox et al. |
| 2012/0223179 | A1 | 9/2012 | Galindo Gonzalez et al. |
| 2015/0291385 | A1 | 10/2015 | Watkins |
| 2015/0291386 | A1 | 10/2015 | Watkins |

FOREIGN PATENT DOCUMENTS

| | | |
|---|---|---|
| FR | 2425486 | 12/1979 |
| FR | 2 572 064 | * 4/1986 |
| GB | 711140 | 6/1954 |
| GB | 719830 | 12/1954 |
| JP | 60052444 | 3/1985 |
| JP | 5127317 | 5/1993 |
| WO | WO 03/035529 | 5/2003 |

OTHER PUBLICATIONS

U.S. Office Action dated Nov. 24, 2021 in U.S. Appl. No. 16/390,733.
U.S. Notice of Allowance dated Feb. 14, 2022 in U.S. Appl. No. 16/390,733.
U.S. Notice of Allowance dated Apr. 16, 2012 in U.S. Appl. No. 12/604,883.
U.S. Office Action dated Dec. 12, 2011 in U.S. Appl. No. 12/604,883.
U.S. Office Action dated Dec. 22, 2015 in U.S. Appl. No. 14/198,348.
U.S. Office Action dated Apr. 25, 2016 in U.S. Appl. No. 14/198,348.
U.S. Notice of Allowance dated May 23, 2016 in U.S. Appl. No. 14/198,348.
First Examination Report issued by the Australian Patent Office dated Dec. 4, 2017 in Australian Patent Application No. 2015207812.
Second Examination Report issued by the Australian Patent Office dated Jul. 27, 2018 in Australian Patent Application No. 2015207812.
Restriction Requirement dated Jul. 30, 2018 in U.S. Appl. No. 15/225,357.
U.S. Office Action dated Oct. 26, 2018 in U.S. Appl. No. 15/225,357.
U.S. Restriction Requirement dated Aug. 27, 2019 in U.S. Appl. No. 15/678,833.
U.S. Office Action dated Feb. 5, 2020 in U.S. Appl. No. 15/678,833.
U.S. Office Action dated Aug. 4, 2020 in U.S. Appl. No. 15/678,833.
U.S. Notice of Allowance dated Nov. 9, 2020 in U.S. Appl. No. 15/678,833.
Australian Examination Report No. 1 dated Jun. 25, 2020 issued in Australian Patent Application No. 2019201257.
McMaster-Carr Catalog, p. 1166, available at http://www.mcmaster.com/#standard-ball-and-roller-bearings/=r6grse last accessed on Jan. 22, 2014.
Encore Wire Corporation brochure for Reel Payoff® dated 2013, retrieved from http://www.encorewire.com/wp-content/uploads/EncWire-ReelPayoff.pdf on Jul. 16, 2014.
Encore Wire Corporation YouTube.com video for Reel Payoff® uploaded on Feb. 5, 2013 retrieved from http://www.youtube.com/watch?v=Gffwx243ETc on Jul. 16, 2014.
DTS1 Drum Tip Stand retrieved from http://www.sebinternational.com/shop.php?sec=prod&prod=75 on Aug. 11, 2016.
Lever Action Cable Reel Jack retrieved from http://www.wctproducts.com/products/reels/lever-action-reel-jack.php on Aug. 11, 2016.
Cable Reel Trolley retrieved from http://www.brandontoolhire.co.

(56) References Cited

OTHER PUBLICATIONS uk/en/moving-and-winching/672-cable-reel-trolley-large.html on Aug. 11, 2016.

* cited by examiner

REEL CHOCK

CROSS-REFERENCE TO RELATED APPLICATIONS

This application is a division of and claims priority to U.S. patent application Ser. No. 15/678,833, entitled "Reel Chock," filed Aug. 16, 2017, now U.S. Pat. No. 10,954,097, which is incorporated herein by reference in its entirety.

BACKGROUND

The present disclosure is directed to reel chocks. More particularly, the present disclosure is directed to a reel chock that can be implemented with a cable reel having components with independent rotation about an axis.

During construction of buildings or the upgrade of electrical/communication systems, cables are typically pulled through a conduit from a source to a destination. For example, a building may be upgraded from copper wires for communication to fiber optic cables. Because of the length of cable needed in certain installations, the cable is typically wound around a cable reel to facilitate transportation and/or installation of the cable. It is understood that other linear elements, such as wires, conductors, rope, and carpet, can be transported and/or stored on reels. Technicians transport the cable reel, which may weigh several tons, from the facility in which the cable was wound to the site in which the cable is to be installed. The cable reel is typically lifted by transport machinery, such as a forklift, from a truck carrying the cable reel to the location in which the cable or other linear element is to be installed. In some systems in use today, the cable reel remains loaded on the truck and the cable is pulled from the reel while the reel remains on the truck. In other cable installations, because of geographical limitations, the cable reel may need to be moved from the truck to the installation location because the truck cannot be physically located at the installation location. The geographical limitations may also prevent the use of the transport machinery, such as a forklift to transport the cable reel to the installation location. This would require the technicians to manually rotate the cable reel to move it from the truck to the installation location.

Because reels are generally circular in structure, uneven surfaces and/or vibrations during travel may set the reels in motion. As mentioned briefly above, reels can weigh several tons when fully wound. Even when no cable is wound on a cable reel, if constructed from a material like metal, the cable reel itself can weigh almost a ton. Thus, the tremendous weight in combination with the inherent rolling characteristics of the reel may pose a serious danger to cables, equipment, and personnel when a perfectly flat storage or transportation surface cannot be provided. Additionally, some reels can be configured to have components that allow for independent rotation about an axis of the reel. As such, preventing uncontrolled movement of the reel can reduce the likelihood of accidents.

SUMMARY

The present disclosure is directed to concepts and technologies for a reel chock that can facilitate the use, transportation, and/or storage of a cable reel. A cable reel of the present disclosure can include two flanges, herein also referred to as "outer flanges" and a drum. The drum, which can be configured to receive a length of cable, can be rotatably mounted on an axle such that the drum rotates independently of the axle. According to other embodiments, the drum can be mounted on the axle such that the drum and the axle rotate together. The drum can include two flanges, herein also referred to as "inner flanges." The inner flanges of the drum can be fixedly mounted on the drum such that the inner flanges and the drum rotate together with one another. The two outer flanges of the cable reel can be rotatably mounted on the axle at opposing, distal ends of the axle. According to embodiments, the two outer flanges of the cable reel can be rotatably mounted on the axle independently of the drum. In some configurations, this provides for the ability of the drum and the inner flanges of the drum to rotate about or with the axle, depending on the configuration of the cable reel, independently of both of the outer flanges of the cable reel. In further configurations, the outer flanges of the cable reel can also rotate independently of the drum and of the axle regardless of whether the drum and axle rotate together with one another or independently of one another. In some configurations, it may be desired for one or more of the outer flanges of the cable reel to remain stationary while the inner flanges of the drum are permitted to rotate. A reel chock can be implemented to secure and prevent rotation of the one or more outer flanges of the cable reel while still allowing for the rotation of the inner flanges of the drum.

In one implementation, a reel chock can include a chock body, a pivot plate, and a pivot arm. The chock body can extend along a pivot axis. The pivot plate can be attached to the chock body, and the pivot plate can be located transverse to the pivot axis. In some embodiments, the chock body has a first inner surface and a second inner surface. The pivot plate can be attached to the first inner surface and the second inner surface. The chock body can form an angle that is at least 90 degrees between the first inner surface and the second inner surface. The pivot arm can be rotatably connected to the pivot plate such that the pivot arm rotates about the pivot axis. The pivot arm can include a fastener portion that extends at least partially over the chock body. In some embodiments, the pivot arm can create a gap between the chock body and the fastener portion when the pivot arm is rotatably connected to the pivot plate. In some embodiments, the reel chock also can include a reel fastener that connects to the fastener portion of the pivot arm. The reel fastener can extend along a reel fastener axis. The fastener portion can define a fastener passage centered about the reel fastener axis, and the fastener passage can allow the reel fastener to move along the reel fastener axis. The reel fastener axis can be transverse to the pivot axis. The reel fastener can extend into the gap between the chock body and the fastener portion in response to the reel fastener moving towards the pivot axis. In some embodiments, the reel chock also can include a magnet. The chock body can include a magnet recess that extends below a surface of the chock body. The magnet can be located at least partially within the magnet recess.

In another configuration, a reel chock can include a chock body, a pivot plate, a support rib, and a pivot arm. The chock body can extend along a pivot axis. The pivot plate can be attached to the chock body, and the pivot plate can be located transverse to the pivot axis. The chock body can have a first inner surface and a second inner surface, and the pivot plate can be attached to the first inner surface and the second inner surface. In some embodiments, the chock body can form an angle that is at least 90 degrees between the first inner surface and the second inner surface. The support rib can be attached to the chock body, and the support rib can be located transverse to the pivot axis. The support rib can be offset from the pivot plate. The pivot arm can be rotatably connected to the pivot plate such that the pivot arm rotates about the pivot axis. The pivot arm can include a fastener portion that extends at least partially over the chock body. In some embodiments, the pivot arm can create a gap between the chock body and the fastener portion when the pivot arm is rotatably connected to the pivot plate. The reel chock also can include a reel fastener. The reel fastener can connect to the fastener portion of the pivot arm and the reel fastener can extend along a reel fastener axis. In some embodiments, the fastener portion can define a fastener passage centered about the reel fastener axis. The fastener passage can allow the reel fastener to move along the reel fastener axis, and the reel fastener axis can be located transverse to the pivot axis. The reel fastener can extend into the gap between the chock body and the fastener portion of the pivot arm in response to the reel fastener moving towards the pivot axis. In some embodiments, the reel chock also can include a magnet. The chock body can include a magnet recess that extends below a surface of the chock body. The magnet can be located at least partially within the magnet recess. In some embodiments, the support rib can define a magnet axis. The magnet can be attached to the support rib such that the magnet is centered about the magnet axis and is located at least flush with an edge of the chock body.

The present disclosure is further directed to a method of assembling a reel chock. The method can include providing a chock body that extends along a pivot axis. The chock body can have a first inner surface and a second inner surface. The chock body can have a pivot plate that is coupled to the first inner surface and the second inner surface. The chock body can form an angle that is at least 90 degrees between the first inner surface and the second inner surface. The method also can include providing a pivot arm. The method also can include coupling the pivot arm to the pivot plate such that the pivot arm is rotatably connected about the pivot axis to the pivot plate. The pivot arm can be secured such that a fastener portion of the pivot arm at least partially extends over the chock body. When the pivot arm is rotatably connected to the pivot plate, a gap between the chock body and the fastener portion of the pivot arm can be created.

In some embodiments, a method of assembling a reel chock can include providing a reel fastener. The reel fastener can be inserted through a fastener passage of the pivot arm. The reel fastener can extend into the gap between the chock body and the fastener portion in response to the reel fastener being inserted towards the pivot axis.

This Summary is provided to introduce a selection of concepts in a simplified form that are further described below in the Detailed Description. This Summary is not intended to be used to limit the scope of the claimed subject matter. Furthermore, the claimed subject matter is not limited to implementations that solve any or all disadvantages noted in any part of this disclosure.

DESCRIPTION OF THE DRAWINGS

The accompanying drawings, which are incorporated in and constitute a part of this disclosure, illustrate various embodiments of the present disclosure. In the drawings:

FIG. 21 illustrates an assembled, perspective view of the embodiment of the reel chock shown in FIGS. 2E-2F.

DETAILED DESCRIPTION

The following detailed description is directed to a reel chock and methods of assembly for holding a reel, spool, or similar device in place. More particularly, the detailed description is directed to a reel chock that allows an outer flange of a reel to be held in place while allowing an interior flange of the reel to rotate independently. According to some implementations, a reel chock of the present disclosure can be placed adjacent to an outer flange of the reel so as to prevent the outer flange of the reel from rotating or otherwise moving. Although embodiments of the reel chock are sometimes described in terms of holding and/or preventing rotation of at least a portion of a reel, it should be understood that the embodiments of the present disclosure may additionally or alternatively be used in other contexts to hold and prevent rotation of other devices such as spools, drums, spindles, bobbins, and similar devices. As such, the particular implementations described herein should not be construed as being limiting in any way. This description provides various components, one or more of which may be included in particular implementations of the systems, methods, and apparatuses disclosed herein. In illustrating and describing these various components, however, it is noted that implementations of the embodiments disclosed herein may include any combination of these components, including combinations other than those shown in this description.

Figure 1B:
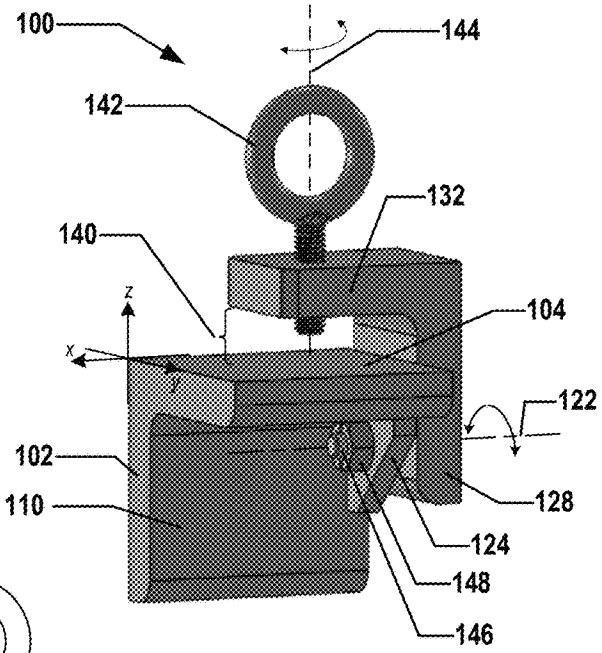
FIGS. 1A-1C illustrate perspective views and a side view of a reel chock, according to an illustrative embodiment of the present disclosure.
Figure 1C:
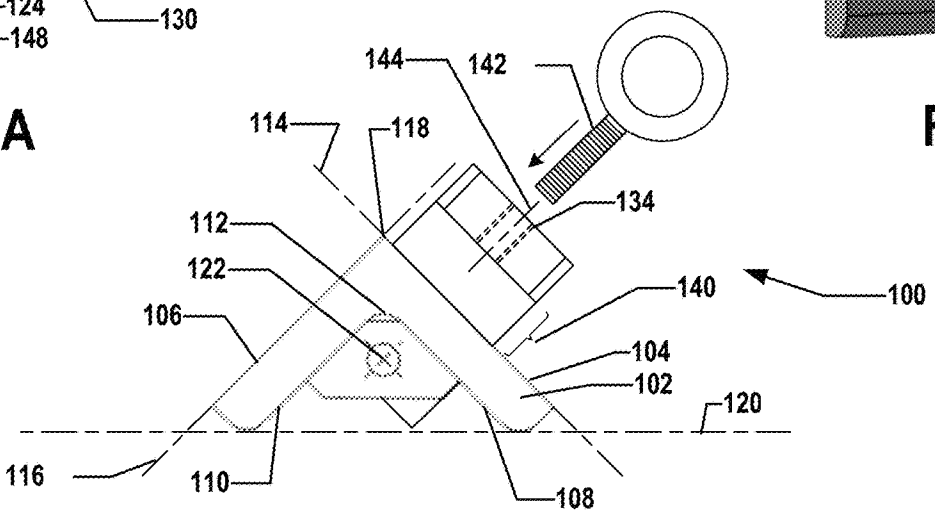
Figure 1A:
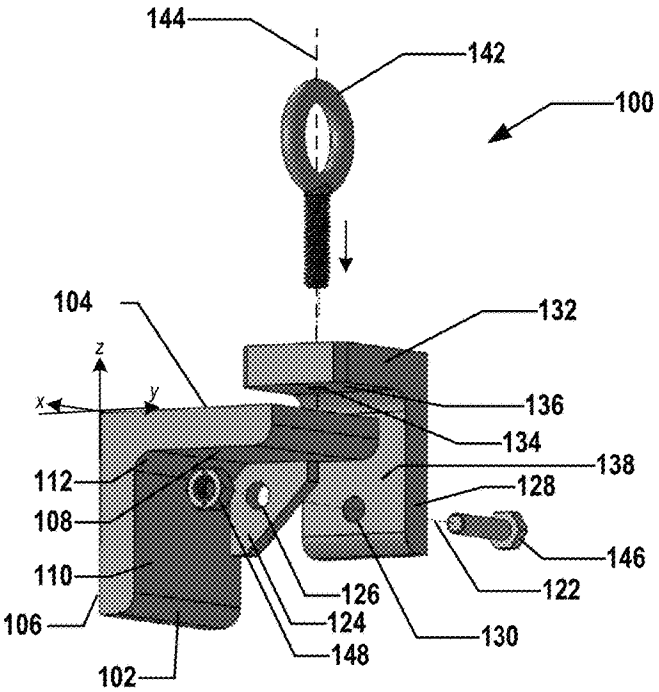

Turning now to FIG. 1A, an exploded, perspective view of a reel chock 100 is presented according to an embodiment. The reel chock 100 can include a chock body 102, a pivot plate 124, and a pivot arm 128. The chock body 102 can be configured to have an "L" shape. In some embodiments, the chock body 102 can have one or more corners and/or edges that have a chamfer, billet, or fillet. The chock body 102 has a width that can extend along a pivot axis 122. A coordinate system is provided in FIG. 1A for clarification purposes only. As shown in FIG. 1A, the pivot axis 122 can run parallel to the x-axis of the coordinate system shown. The chock body 102 can include a first outer surface 104 and a second outer surface 106. For clarification purposes, the first outer surface 104 is oriented parallel to an XY plane 114 of the coordinate system, as illustrated in FIG. 1C. In some embodiments, the first outer surface 104 and/or the second outer surface 106 can be in contact with a cable reel, such as when the reel chock 100 is positioned to restrain a flange of the cable reel. Similarly, the second outer surface 106 is oriented parallel to an XZ plane 116 of the coordinate system, as illustrated in FIG. 1C. The chock body 102 also can include a first inner surface 108 and a second inner surface 110. The width of each of the first outer surface 104, the second outer surface 106, the first inner surface 108, and the second inner surface 110 can extend along and/or parallel to the pivot axis 122. It is understood that the use of the terms "first" and "second" are for clarification purposes only, and are not meant to imply an order, ranking, or other hierarchy. The first inner surface 108 and the second inner surface 110 can meet to form an angle 112. In some embodiments, the angle 112 can be acute, obtuse, or ninety degrees. In some embodiments, the angle 112 is at least ninety degrees between the first inner surface 108 and the second inner surface 110. By the angle 112 being at least ninety degrees, the tendency for the chock body 102 to rotate around the pivot axis 122 can be reduced. This can be because the moment of inertia is "lowered" (i.e., closer towards the pivot axis 122) when the angle 112 is at least 90 degrees. As such, when an external force is applied to the first outer surface 104, the moment created may not be great enough to cause the chock body 102 to tip over. In some embodiments, the chock body 102 can be made of metal, wood, composite, or any other rigid and inflexible material. The thickness of the material between the first outer surface 104 and the first inner surface 108 can vary. In some embodiments, the material between the first outer surface 104 and the first inner surface 108 can be the same or different thickness as the material between the second outer surface 106 and the second inner surface 110.

The pivot plate 124 can be attached to the chock body 102. Specifically, in embodiments, the pivot plate 124 can attach to the first inner surface 108 and the second inner surface 110 of the chock body 102. For example, the pivot plate 124 can be welded to the first inner surface 108 and/or the second inner surface 110, although this may not necessarily be the case. Other securing mechanisms can be employed to attach the pivot plate 124 to the chock body 102 depending on material type, including but not limited to, adhesives, rivets, screws, molding, brazing, or soldering. It is understood that the examples are provided for illustration purposes only and should not be construed as limiting the disclosure in any way. The pivot plate 124 can intersect the pivot axis 122. Thus, in some embodiments, the pivot plate 124 can be located transverse to the pivot axis 122. The pivot plate 124 can define a pivot plate opening 126, which can be centered about the pivot axis 122. The pivot plate opening 126 can be configured to accept a pivot connector 146, and thus the size of the pivot plate opening 126 (e.g., diameter) can vary depending on a size of a pivot connector 146. In some embodiments, the pivot plate opening 126 can have threads that engage a portion of the pivot connector 146. In other embodiments, the inner surface of the pivot plate opening 126 can be smooth or otherwise non-threaded. As illustrated, the pivot plate opening 126 is a round opening, although this may not necessarily be the case. In some embodiments, the pivot plate opening 126 can retain a bearing (e.g., a ball bearing) that surrounds the pivot connector 146, thereby allowing the pivot connector 146 to rotate freely about the pivot axis 122. The pivot plate opening 126 can be sized so as to restrain a pivot connector retainer 148 from passing through the pivot plate opening 126. In some embodiments, the pivot connector 146 can be a bolt and the pivot connector retainer 148 can be a nut that is configured to be threaded onto at least a portion of the pivot connector 146. In other embodiments, the pivot connector 146 can include a clevis pin that has a rigid shaft and a retention hole through which the pivot connector retainer 148 (taking the form of a wire pin) can be inserted. It is understood that the examples are provided for illustration purposes only and should not be construed as limiting the disclosure in any way. The pivot plate 124 can be located on a distal edge of the chock body 102, thereby allowing the pivot plate 124 to be adjacent to the pivot arm 128.

The reel chock 100 also can include the pivot arm 128. The pivot arm 128 can be located next to the chock body 102 and the pivot plate 124. The pivot arm 128 can be rotatably connected to the pivot plate 124 such that the pivot arm 128 rotates about the pivot axis 122. For example, the pivot arm 128 can define a connector passage 130 through which at least a portion of the pivot connector 146 can pass. The connector passage 130 can be a bore hole through the material of the pivot arm 128 and can be sized larger than a shaft of the pivot connector 146, thereby allowing the pivot arm 128 to rotate about the pivot axis 122 while also being held in place along the pivot axis 122 by the pivot connector 146. The pivot arm 128 can include a first inner surface 136 and a second inner surface 138. The second inner surface 138 can face the pivot plate 124 such that the second inner surface 138 is substantially parallel to the pivot plate 124. The connector passage 130 of the pivot arm 128, which extends through the second inner surface 138 of the pivot arm 128, can be centered about, and thus align with, the pivot axis 122. As such, the pivot connector 146 can pass through the connector passage 130 and the pivot plate opening 126, where the pivot connector 146 can be axially restrained by the pivot connector retainer 148, such as shown in FIG. 1B.

Turning to FIGS. 1B and 1C with continued reference to FIG. 1A, assembled views of the reel chock 100 are shown. As illustrated, the pivot arm 128 can include a fastener portion 132. In some embodiments, the fastener portion 132 can extend substantially parallel to the pivot axis 122, thereby causing the pivot arm 128 to form an "L" shape. As illustrated in FIGS. 1A and 1B, the first inner surface 136 of the pivot arm 128 can be a surface of the fastener portion 132. As such, the first inner surface 136 can be substantially orthogonal to the second inner surface 138. The fastener portion 132 can extend at least partially over the chock body 102. Because the pivot arm 128 can rotate about the pivot axis 122, the fastener portion 132 can be positioned so as to extend over the first outer surface 104 and/or the second outer surface 106 of the chock body 102. In some embodiments, the pivot arm 128 can create a gap 140 between the chock body 102 and the fastener portion 132 of the pivot arm 128 when the pivot arm 128 is rotatably connected to the pivot plate 124. Specifically, when the fastener portion 132 is oriented so as to extend over the first outer surface 104 of the chock body 102, then the gap 140 is located between the first outer surface 104 of the chock body 102 and the first inner surface 136 of the pivot arm 128. Similarly, when the fastener portion 132 is oriented so as to extend over the second outer surface 106 of the chock body 102, then the gap 140 would be located between the second outer surface 106 of the chock body 102 and the first inner surface 136 of the pivot arm 128. In some embodiments, the pivot arm 128 can be rotated such that the fastener portion 132 extends over a portion of the chock body 102 where the first outer surface 104 meets or otherwise transitions to the second outer surface 106, such as at a vertex 118 of the chock body 102. In this embodiment, the gap 140 would be located between the vertex 118 and the first inner surface 136 of the pivot arm 128. In some embodiments, the transition between the first outer surface 104 and the second outer surface 106 is continuous, so as to form a fillet instead of a vertex. Irrespective of the shape, the pivot arm 128 can be rotatably connected so as to extend over at least a portion of the first outer surface 104 and/or the second outer surface 106. This can allow the reel chock 100 to be positioned underneath either outer flange of a cable reel.

In some embodiments, the pivot arm 128 can include a fastener passage 134. Specifically, the fastener portion 132 can define the fastener passage 134 centered about a reel fastener axis 144. The fastener passage 134 can be a bore hole that is orthogonal to the connector passage 130 of the pivot arm 128 and the pivot plate opening 126 of the pivot plate 124. As such, the reel fastener axis 144 can be transverse to the pivot axis 122. The reel chock 100 also can include a reel fastener 142. The reel fastener 142 can connect to the pivot arm 128, specifically via the fastener passage 134 of the fastener portion 132. The reel fastener 142 can extend along the reel fastener axis 144. As illustrated, the reel fastener 142 is shown as an eyebolt, although this may not necessarily be the case for all embodiments. The fastener passage 134 can allow the reel fastener 142 to move axially along the reel fastener axis 144. For example, the fastener passage 134 can be threaded so as to removably engage with threads on a portion of the reel fastener 142. The reel fastener 142 can extend into the gap 140 between the chock body 102 and the fastener portion 132 in response to the reel fastener 142 moving along the reel fastener axis 144 and towards the pivot axis 122. As further discussed with respect to FIGS. 3A-3D, when the reel chock 100 is positioned below a portion of a flange of a cable reel, the flange of the cable reel can be located within the gap 140 and the reel fastener 142 can frictionally engage a portion of the flange so as to restrain the flange of the cable reel and thereby prevent at least a portion of the cable reel from moving. Thus, the reel fastener 142 can restrain a portion of the cable reel by providing a normal force to the cable reel along the reel fastener axis 144.

As shown in FIG. 1C, the reel chock 100 can be oriented such that the chock body 102 is located on a ground plane 120 that corresponds with a surface in which the reel chock 100 is positioned underneath a cable reel. The chock body 102 can form an "L" shape, and the pivot arm 128 can rotate about the pivot axis 122 while each end of the chock body 102 is in contact with the ground plane 120. As shown in FIG. 1C, the XY plane 114 corresponds with the first outer surface 104 of the chock body 102 and intersects the ground plane 120. Similarly, the XZ plane 116 corresponds with the second outer surface 106 of the chock body 102 and intersects the ground plane 120. The XZ plane 116 corresponding with the second outer surface 106 of the chock body 102 can be orthogonal to the XY plane 114 corresponding with the first outer surface 104 of the chock body 102. The pivot axis 122 can be substantially parallel to the ground plane 120. When positioned below a cable reel, the reel chock 100 can receive a force against one of the first outer surface 104 or the second outer surface 106, which in turn is distributed along the ground plane 120 via the chock body 102. The weight of the cable reel against the chock body 102 creates a frictional bond between the cable reel and the chock body 102, and in turn, the chock body 102 and the surface material oriented along the ground plane 120. As such, the greater the weight of the cable reel, the stronger the frictional force. The reel fastener 142 can be extended through the fastener passage 134, along the reel fastener axis 144 towards the pivot axis 122, until the end of the reel fastener 142 is in frictional contact with a material located in the gap 140, such as the material of a flange or other portion of the cable reel. When the reel chock 100 is not in use, and thus not positioned below the cable reel, the reel chock 100 can be stored on a portion of the cable reel, such as via frictional attachment to a rib of the cable reel.

Figure 1E:
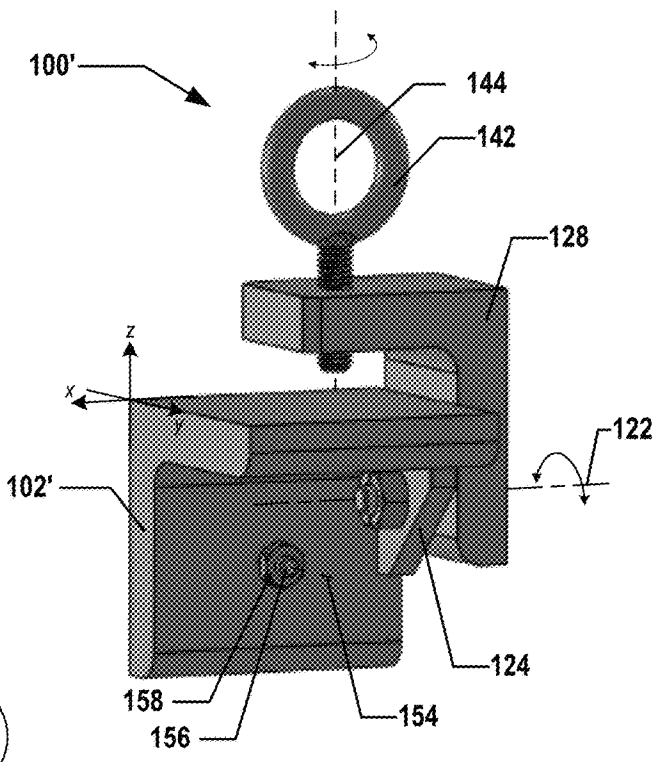
FIGS. 1D-1F illustrate perspective views and a side view of a reel chock, according to another embodiment of the present disclosure.
Figure 1D:
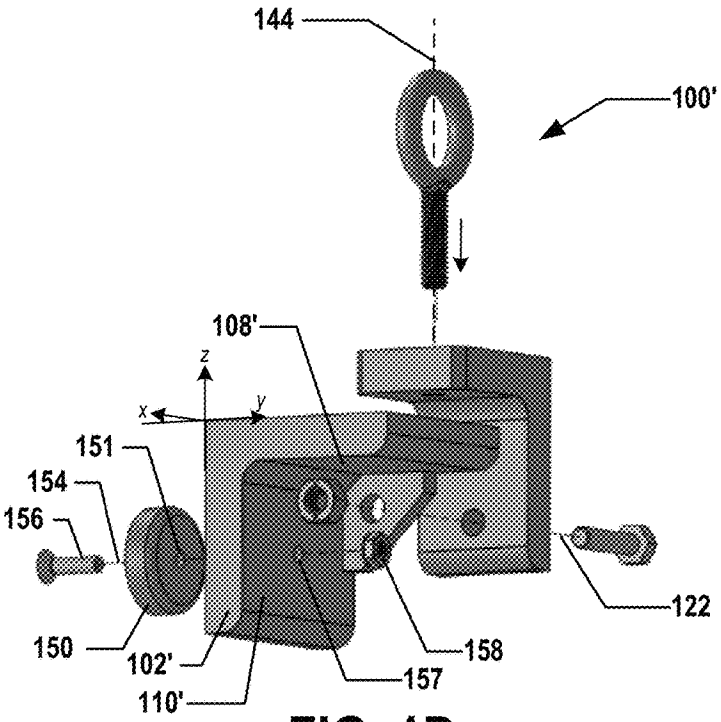
Figure 1F:
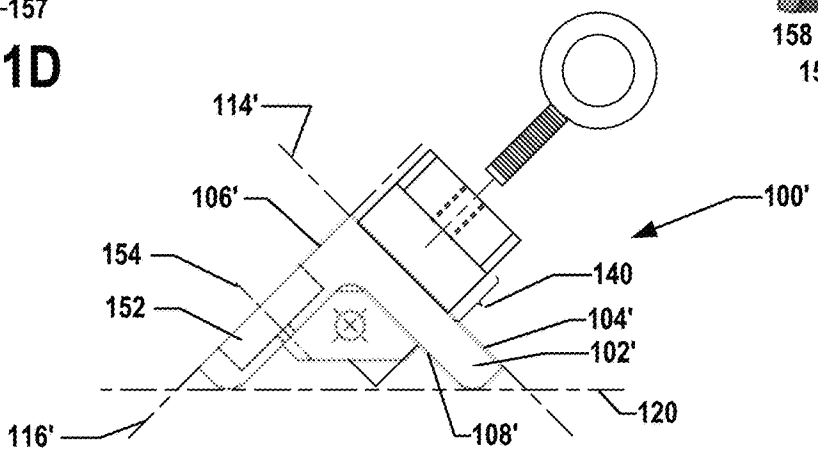
Figure 2A:
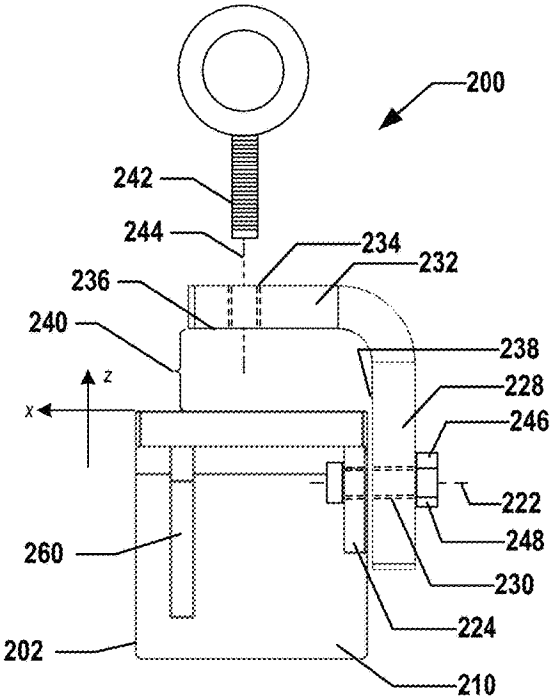
FIGS. 2A-2D illustrate a top, front, side, and perspective view a reel chock according to a third embodiment of the present disclosure.
Figure 2B:
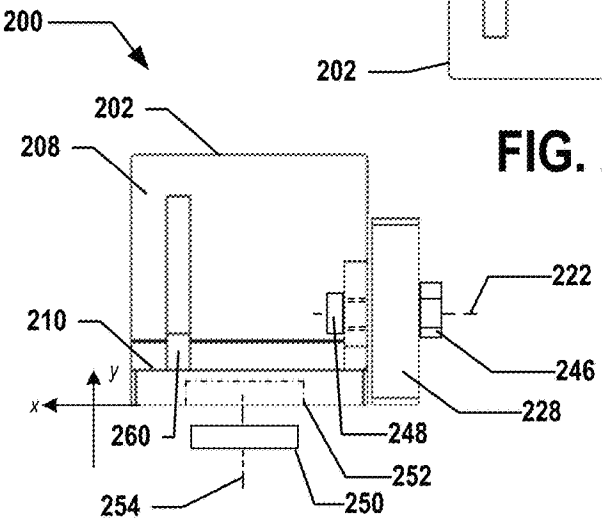
Figure 2C:
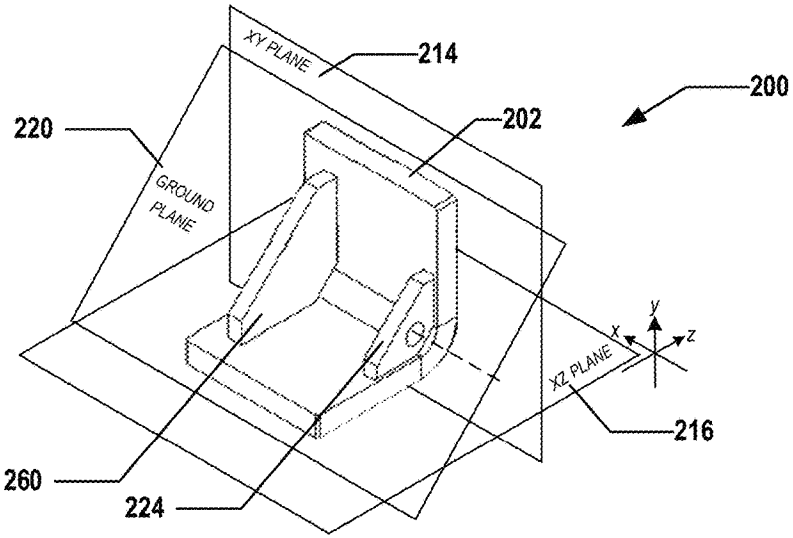
Figure 2D:
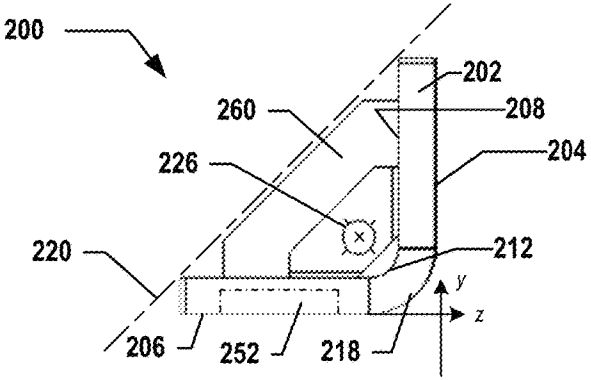
Figure 2E:
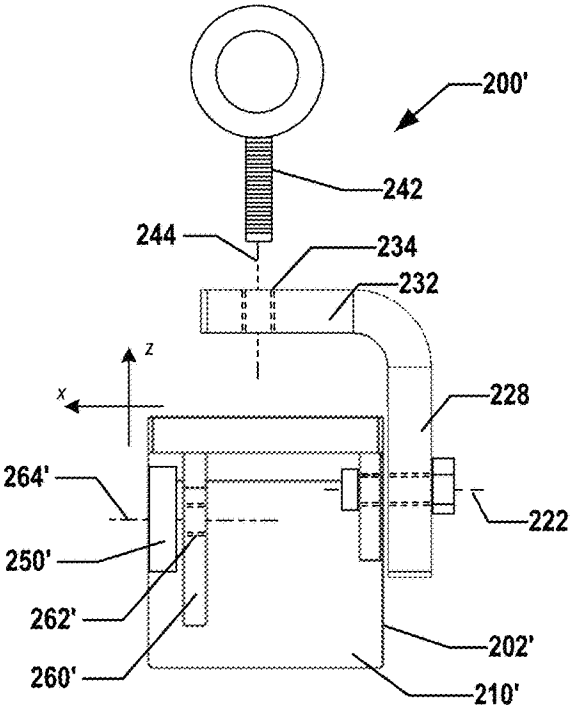
FIGS. 2E-2F illustrate a top and front view of a fourth embodiment of a reel chock, according to the present disclosure.
Figure 2F:
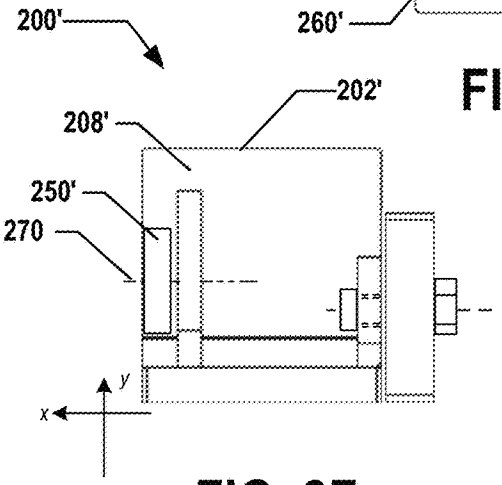
Figure 2G:
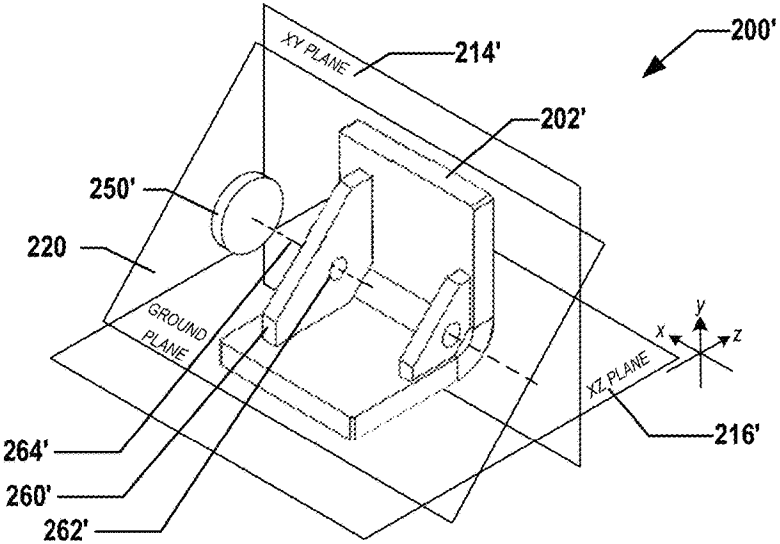
FIGS. 2G-2H illustrate a perspective and side view of the embodiment of the reel chock from FIGS. 2E-2F with the pivot arm being omitted from view for clarity purposes, according to the present disclosure.
Figure 2H:
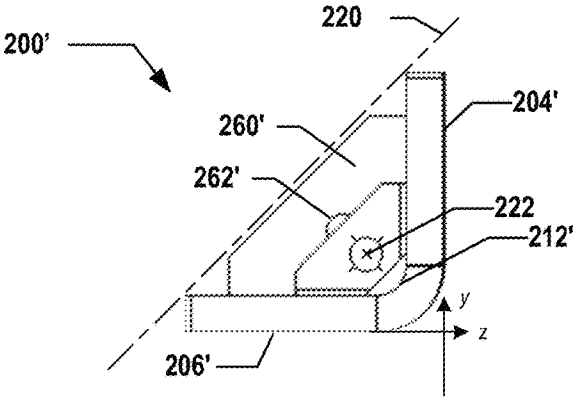
Figure 2I:
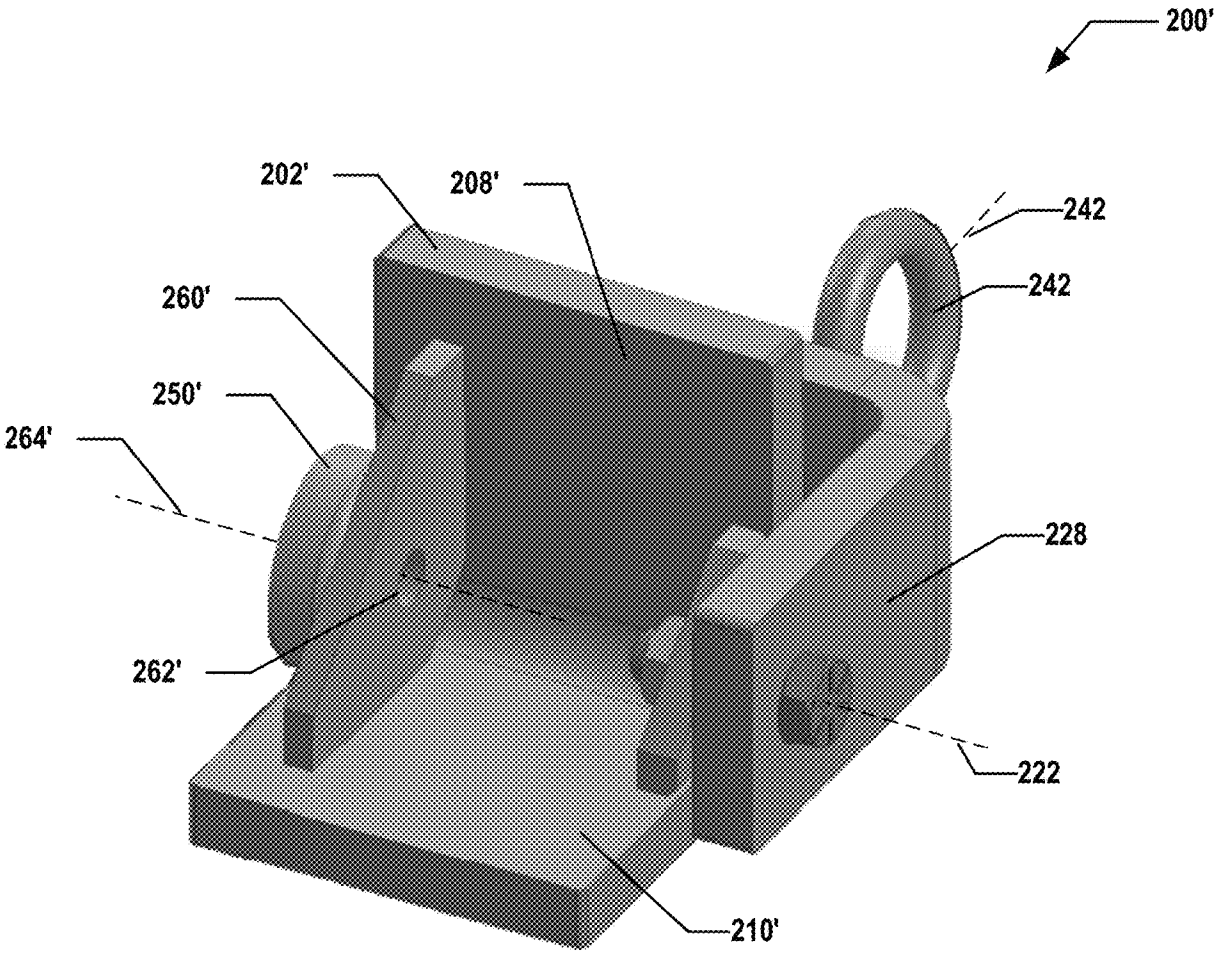

Turning now to FIGS. 1D-1F, a reel chock 100' is disclosed, according to another embodiment of the concept and technologies discussed herein. The reel chock 100' is substantially similar to the reel chock 100 from FIGS. 1A-1C. For example, the reel chock 100' can include the pivot arm 128 that is rotatably connected to the pivot plate 124 about the pivot axis 122. Similarly, the reel chock 100' also can include the reel fastener 142 that extends along the reel fastener axis 144 and into the gap 140 when removably engaging with the pivot arm 128. Thus, for clarity, distinctions from the reel chock 100 will be discussed. As shown in FIGS. 1D-1F, the reel chock 100' includes the chock body 102'. The chock body 102' can be substantially similar to the chock body 102 discussed above. The chock body 102' can include a first outer surface 104', a second outer surface 106', a first inner surface 108', and a second inner surface 110'. However, the chock body 102' also can include a magnet recess 152. The magnet recess 152 can be located on a portion of the chock body 102' that is the same side as the second outer surface 106'. The second outer surface 106' can correspond to an XZ plane 116' and be orthogonal to the first outer surface 104' of the chock body 102', which corresponds to an XY plane 114'. Similar to the discussion above with respect to chock body 102, the chock body 102' can be placed in contact with the ground plane 120 such that the XZ plane 116' and the XY plane 114' intersect the ground plane 120. The magnet recess 152 can extend at least partly into the material of the chock body 102' along a magnet recess axis 154. The magnet recess axis 154 can be orthogonal to the pivot axis 122 and/or the reel fastener axis 144. The magnet recess 152 can extend below the second outer surface 106' of the chock body 102'. In some embodiments, the chock body 102' can define a magnet recess passage 157 that extends along the magnet recess axis 154 and through the chock body 102'. Thus, the magnet recess passage 157 can extend through the second inner surface 110' of the chock body 102'. The chock body 102' can be configured such that an angle between the first inner surface 108' and the second inner surface 110' can be an acute angle, an obtuse angle, or ninety degrees.

The reel chock 100' also can include a magnet 150. The magnet 150 can be configured with a shape that matches, compliments, or otherwise engages with the magnet recess 152. As shown, the magnet 150 is circular in shape, although this may not always be the case. As such, the examples are provided for illustration purposes only, and should not be construed so as to limit the scope of the present disclosure. When the reel chock 100' is assembled, the magnet 150 can be located at least partially within the magnet recess 152. The magnet 150 can include a magnet fastener passage 151 that is oriented or aligned along the magnet recess axis 154. In some embodiments, the magnet 150 can be held in place by a magnet fastener 156. The magnet fastener 156 can be configured so as to pass through the magnet fastener passage 151 and the magnet recess passage 157. In some embodiments, the magnet fastener passage 151 can be threaded so as to removably engage with threads of the magnet fastener 156. In other embodiments, the magnet fastener passage 151 is smooth, and the magnet fastener 156 is axially held in place via a magnet fastener retainer 158. In some embodiments, the magnet fastener 156 can include a bolt and the magnet fastener retainer 158 can include a nut that removably engages with the magnet fastener 156. The magnet fastener 156 can be configured such that the magnet 150 is axially restrained from movement along the magnet recess axis 154. In alternate embodiments, the magnet 150 can be press fit or otherwise frictionally restrained within the magnet recess 152 without the use of a magnet fastener 156. As illustrated in the embodiments of FIG. 1D, the magnet 150 can have a diameter that extends parallel to the pivot axis and transverse to the magnet recess axis 154. The magnet 150 of the reel chock 100' can allow the reel chock 100' to be magnetically attached to a ferrous surface of a cable reel when the reel chock 100' is not in use, thereby providing quick and easy storage. For example, when the reel chock 100' is not in use, the reel chock 100' can be magnetically attached, via the magnet 150, to a rib or other portion of an outer flange of a cable reel. This can allow for storage of the reel chock 100' in a location that on the cable reel that is accessible and convenient for technicians.

Turning now to FIGS. 2A-2D, a reel chock 200 is disclosed according to another embodiment of the present disclosure. The reel chock 200 may be substantially similar to the reel chock 100 and/or the reel chock 100' discussed with respect to FIGS. 1A-1C and 1D-1F, respectively. The reel chock 200 can include a chock body 202 that has a width that extends along a pivot axis 222. The chock body 202 can be substantially similar to the chock body 102 and/or 102'. The chock body 202 can have a first inner surface 208 and a second inner surface 210. In some embodiments, the chock body 202 forms an angle 212 that is at least 90 degrees or greater between the first inner surface 208 and the second inner surface 210. The chock body 202 can have a first outer surface 204 that corresponds with an XY plane 214 of a coordinate system. The chock body 202 also can have a second outer surface 206 that is orthogonal to the first outer surface 204. The second outer surface 206 can correspond with an XZ plane 216 of a coordinate system. When in use, the reel chock 200 can be oriented such that the chock body 202 is in contact with a ground plane 220 that corresponds with a planar surface on which the reel chock 200 can be placed and/or located. The ground plane 220 can intersect the XY plane 214 and the XZ plane 216. Each of the ground plane 220, XY plane 214 and the XZ plane 216 can be parallel to the pivot axis 222.

The reel chock 200 also can include a pivot plate 224. The pivot plate 224 can be attached to the first inner surface 208 and the second inner surface 210 of the chock body 202. The pivot plate 224 can be located transverse to the pivot axis 222 such that the pivot plate 224 is orthogonal to at least a portion of the chock body 202. The chock body 202 can be configured in an "L" shape, and the pivot plate 224 can be attached to an inner portion of the chock body 202. The pivot plate 224 can include a pivot plate opening 226 that is centered about the pivot axis 222. The pivot plate opening 226 can be substantially similar to the pivot plate opening 126.

The reel chock 200 also can include a pivot arm 228 that is rotatably connected to the pivot plate 224 such that the pivot arm 228 rotates about the pivot axis 222. The pivot arm 228 can be substantially similar to the pivot arm 128 of the reel chock 100. The pivot arm 228 can be connected to the pivot plate 224 via a pivot connector 246 that extends through a connector passage 230 of the pivot arm 228. The pivot arm 228 and the pivot connector 246 can be axially secured and/or restrained via a pivot retainer 248. The pivot connector 246 and the pivot retainer 248 can be substantially similar to the pivot connector 146 and the pivot connector retainer 148 discussed above with respect to reel chock 100. The pivot connector 246 can allow the pivot arm 228 to rotate about the pivot axis 222 while the pivot arm 228 is located adjacent to the chock body 202. The pivot arm 228 can comprise a fastener portion 232 that extends at least partially over the chock body 202. The pivot arm 228 can include a first inner surface 236 that is parallel to the pivot axis 222, and the pivot arm 228 can include a second inner surface 238 that is located next to the pivot plate 224 and is transverse to the pivot axis 222. In some embodiments, the pivot arm 228 can create a gap 240 between the chock body 202 and the fastener portion 232 of the pivot arm 228 when the pivot arm 228 is rotatably connected to the pivot plate 224. Specifically, in some embodiments, the gap 240 can be created between the first inner surface 236 of the pivot arm 228 and the first outer surface 204 of the chock body 202. Because the pivot arm 228 can rotate about the pivot axis 222, it is understood that the gap 240 can also be formed between the first inner surface 236 of the pivot arm 228 and a vertex 218 of the chock body 202, and/or the gap 240 can be formed between the first inner surface 236 of pivot arm 228 and the second outer surface 206 of the chock body 202.

The fastener portion 232 of the pivot arm 228 can define a fastener passage 234 that is centered about a reel fastener axis 244. The reel fastener axis 244 can be transverse to the pivot axis 222. The reel fastener 242 can removably engage with the fastener passage 234, such as via a threaded coupling. The fastener passage 234 can be configured so as to allow the reel fastener 242 to move along the reel fastener axis 244. The reel fastener 242 can extend along the reel fastener axis 244, and thus be configured to axially move orthogonal to the pivot axis 222. The reel fastener 242 can extend into the gap 240 between the chock body 202 and the fastener portion 232 of the pivot arm 228 in response to the reel fastener 242 moving towards the pivot axis 222. When a flange of a cable reel is located within the gap 240, the reel fastener 242 can be extended into the gap 240 and apply a normal force to the cable reel, thereby holding the cable reel via frictional engagement.

In some embodiments, the reel chock 200 can include a magnet 250. In some embodiments, the chock body 202 can include a magnet recess 252 that extends at least partially below a surface of the chock body 202, such as the second outer surface 206. The magnet 250 can be centered about a magnet recess axis 254. The magnet recess 252 can be configured to accept and retain the magnet 250 via frictional engagement and/or via use of a magnet fastener, such as discussed with respect to the reel chock 100'.

In some embodiments, the reel chock 200 can include a support rib 260. In embodiments, the support rib 260 can be configured in a shape substantially similar to that of the pivot plate 224. The support rib 260 can be attached to the first inner surface 208 and the second inner surface 210 of the chock body 202. The support rib 260 can be located transverse to the pivot axis 222, and thus the support rib 260 can be disposed orthogonally to the first inner surface 208 and the second inner surface 210. In some embodiments, the support rib 260 can be in contact with a surface located at the ground plane 220 when the reel chock 200 is located below a cable reel. In other embodiments, only the chock body 202 is in contact with a surface located along the ground plane 220. The support rib 260 can be offset a distance from the pivot plate 224. The offset can create a void below the first inner surface 208 and the second inner surface 210 and between the support rib 260 and the pivot plate 224.

Turning now to FIGS. 2E-2H, a reel chock 200' is disclosed according to another embodiment of the present disclosure. The reel chock 200' can be substantially similar to the reel chock 200 discussed above with respect to FIGS. 2A-2D. Therefore, the discussion above applies to numbered elements in FIGS. 2E-2H that are also shown and discussed with respect to FIGS. 2A-2D. As such, a discussion of the distinctions in the reel chock 200' is provided. For example, in some embodiments, a first or second outer surface 204', 206' of the chock body 202' does not contain a magnet recess, such as the magnet recess 252 of the chock body 202. This is because the reel chock 200' can include a magnet 250' that is configured to attach to the support rib 260'. The support rib 260' can attach to a first inner surface 208' and a second inner surface 210' of the chock body 202'. The support rib 260' can be transverse to the pivot axis 222 and can be located orthogonal to the first inner surface 208' and the second inner surface 210' of the chock body 202'. The support rib 260' can define a magnet axis 264', where the magnet axis 264' can be substantially parallel to the pivot axis 222. The support rib 260' can include a support rib opening 262' that is centered about the magnet axis 264'. In some embodiments, the magnet 250' can be axially retained by a magnet fastener and/or magnet fastener retainer, similar to the magnet fastener 156 and the magnet fastener retainer 158 discussed above with respect to the reel chock 100'. The magnet 250' can include a magnet fastener passage such that the magnet fastener can be inserted through the magnet fastener passage and the support rib opening 262'. The magnet fastener can be axially restrained along the magnet axis 264' via the magnet fastener retainer.

In some embodiments, the magnet 250' is attached to the support rib 260' such that the magnet 250' is centered about the magnet axis 264', such as shown in FIG. 21. The magnet axis 264' can be parallel to the pivot axis 222, but may not necessarily be at the same coordinate position with the pivot axis 222. In some embodiments, the magnet 250' is attached to the support rib 260' such that the magnet 250' is located at least flush with an edge of the chock body 202'. For example, the magnet 250' can be distally located from the pivot arm 228 such that the pivot arm 228 connects to the pivot plate 224 on one side of the chock body 202', while the magnet 250' is parallel to at least a portion of the pivot arm 228 and attached to the support rib 260' at another end of the chock body 202'. The magnet 250' can be substantially similar to the magnet 250 of the reel chock 200 and/or the magnet 150 of the reel chock 100'. The magnet 250' can be sized such that the magnet 250' does not cross the ground plane 220, thereby not coming into contact with a surface material that is planar to the ground plane 220. The magnet 250' of the reel chock 200' can facilitate rapid storage of the reel chock 200' to a ferrous surface, such as of a cable reel, when the reel chock 200' is not in use preventing rotation of at least a portion of a cable reel. The magnet 250' (or any of the other magnets, such as the magnet 250 and/or 150) can be configured to be strong enough to withstand and counteract gravitational forces applied to the reel chock 200' because the magnetic force of the magnet 250' is greater than the gravitational force of the reel chock 200'.

Turning now to FIGS. 3A-3D, a discussion of example implementations of embodiments of a reel chock, such as the reel chock 100, is provided as oriented with respect to a system 300 with a cable reel 301 that is held in place by one or more of the reel chock 100. As illustrated, an embodiment of the reel chock 100 is implemented for restraining the cable reel 301. However, it should be understood that other embodiments of the reel chock 100 can be implemented, such as any of the reel chock 100', the reel chock 200, and/or the reel chock 200'. As such, the following discussion is provided for clarification purposes only and should not be construed as limiting the disclosure in any way.

Figure 3A:
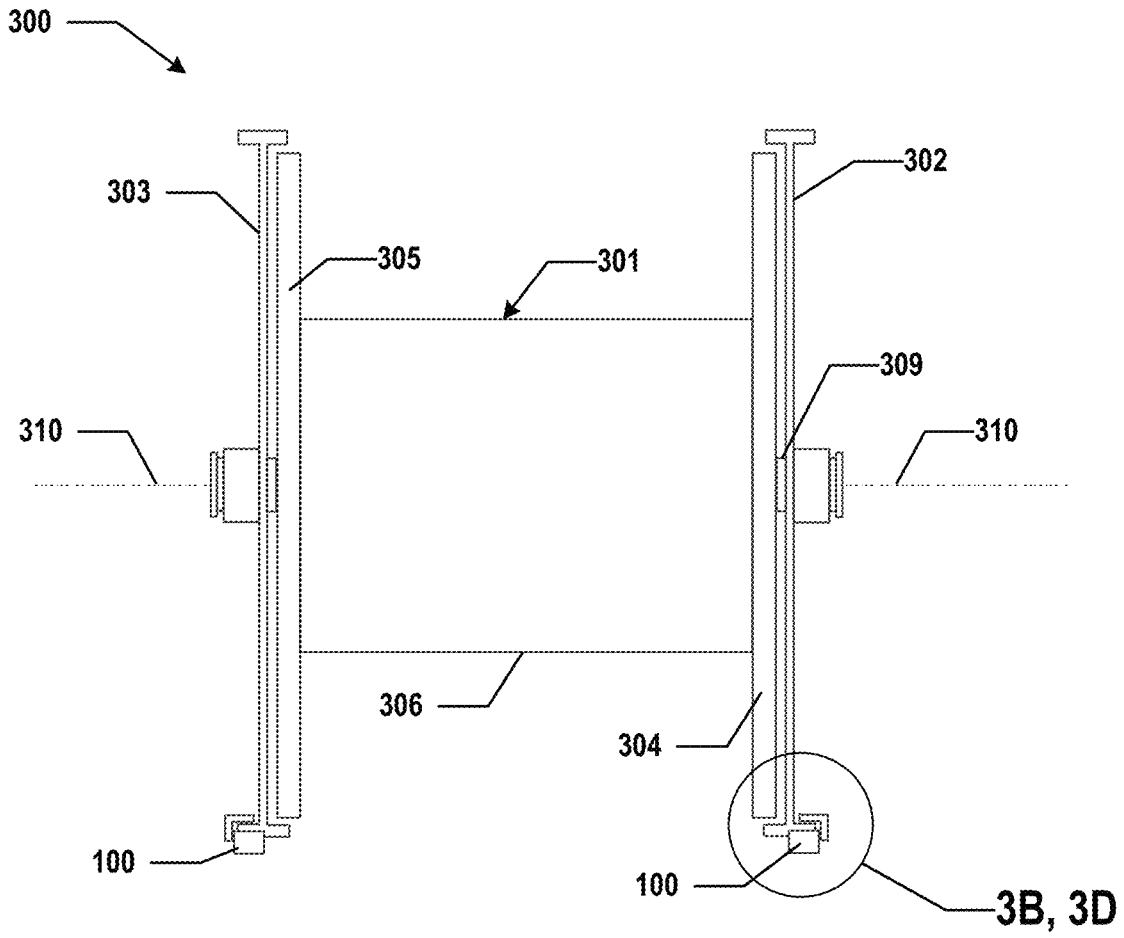
FIGS. 3A-3B illustrate a system with a cable reel and a reel chock, specifically showing a front, cross-section view of a cable reel relative to a reel chock, according to illustrative embodiments.

FIG. 3A shows a front, cross-section view of the cable reel 301 positioned on a surface of the ground plane 120, where the cable reel 301 is located relative to the reel chock 100. The cable reel 301 can include a drum 306 that is configured to rotate about a reel axis 310. The drum 306 can be configured to receive a length of linear element, such as a fiber optic cable. In some embodiments, the drum 306 can be rotatably mounted on an axle 309 of the cable reel 301 such that the drum 306 can rotate independently of the axle 309. In other embodiments, the drum 306 can be mounted on the axle 309 such that the drum 306 and the axle 309 rotate with one another. Additionally, the cable reel 301 can include a set of outer flanges 302, 303 and a set of inner flanges 304, 305. In some embodiments, the outer flanges 302, 303 can rotate about the reel axis 310 and can rotate independently from the set of the inner flanges 304, 305, which also can rotate about the reel axis 310. In some embodiments, the set of the outer flanges 302, 303 can be rotationally mounted on the axle 309 at opposing, distal ends of the axle 309 such that the set of the outer flanges 302, 303 rotate independently of the axle 309. In some embodiments, the set of the inner flanges 304, 305 can be mounted to the drum 306, and the drum 306 and the inner flanges 304, 305 can rotate independently from the set of the outer flanges 302, 303. This can allow the drum 306 and the set of the inner flanges 304, 305 to rotate while the set of the outer flanges 302, 303 remain stationary. Since the drum 306 and the set of the inner flanges 304, 305 can rotate independently from the set of the outer flanges 302, 303, the cable reel 301, via the outer flanges 302, 303, can be restrained in position on the ground plane 120 by one or more reel chocks, such as the reel chock 100, while still allowing cable or other linear elements to be wound onto, or unwound from, the drum 306. It is understood that the ground plane 120 may be an uneven surface, and thus movement of the cable reel 301 can be prevented via use and placement of the reel chock 100 below one or more of the set of outer flanges 302, 303. FIG. 3A includes a reference to aspects of the configuration of details when the reel chock 100 is implemented to restrain movement of the set of the outer flanges 302, 303 of the cable reel 301 while still allowing the drum 306 and the set of the inner flanges 304, 305 to rotate freely. Additional aspects and embodiments of a cable reel for which a reel chock (e.g., any of the reel chocks 100, 100', 200, and/or 200') can be implemented, can be found in U.S. Pat. No. 9,403,659, the contents of which are herein incorporated by reference in their entirety.

Figure 3B:
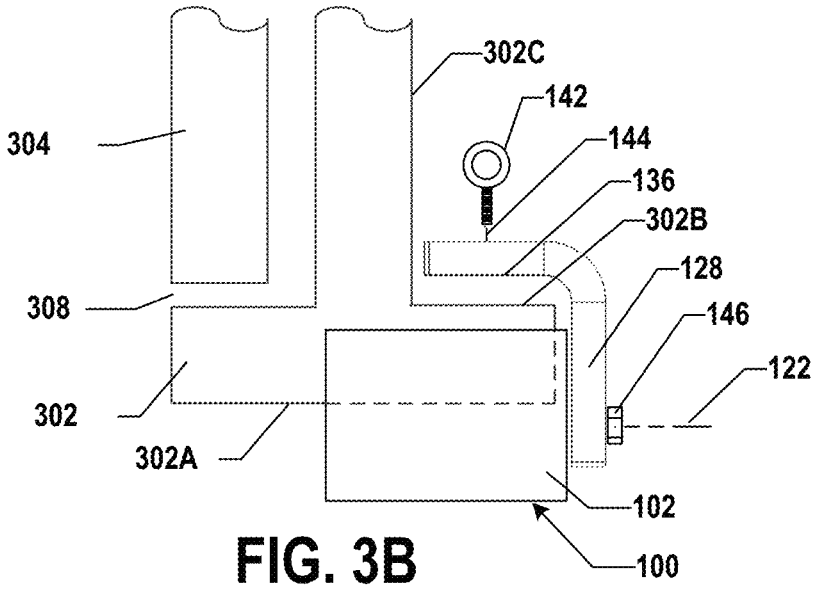

As shown in FIG. 3B, the outer flange 302 can have a cross-section shape of the letter "I". An outer surface 302A of the outer flange 302 can be in contact with the ground plane 120. The inner flange 304 can be nested within an inner lip of the outer flange 302, thereby creating a flange gap 308 between the inner flange 304 and the outer flange 302. The reel chock 100 can have a width that extends along the pivot axis 122, which can extend substantially in parallel with the reel axis 310. In some embodiments, the chock body 102 of the reel chock 100 has a width that extends only partially along the outer surface 302A of the outer flange 302. However, in other embodiments, the chock body 102 can be of equal or great width as that of the outer surface 302A, and thus extend along the entire width of the outer surface 302A. The reel chock 100 can be adapted to the width of the outer flange 302 so as to maximize the amount of contact surface, and thus in turn increase the frictional bond to restrain rotation of the outer flange 302.

The pivot arm 128 of the reel chock 100 can be rotated such that the outer flange 302 is positioned between the first inner surface 136 of the pivot arm 128 and the second outer surface 106 of the chock body 102. For the outer flange 303, the pivot arm 128 of the reel chock 100 can be rotated such that the outer flange 303 is positioned between the first inner surface 136 of the pivot arm 128 and the first outer surface 104 of the chock body 102, which allows the same reel chock 100 to be used on either of the outer flanges 302, 303 of the cable reel 301. Instead of requiring two structurally different devices—one structurally designed to work on the right-side outer flange 303 and one structurally designed to work on the left-side outer flange 302—to impede rotation of the outer flanges 302, 303, embodiments of the present disclosure allow for the same reel chock 100 to be used to prevent rotation of either of the outer flanges 302, 303 by rotating the pivot arm 128 relative to the chock body 102 so that one of the outer flanges 302, 303 is located in the gap 140. In some embodiments, the reel fastener 142 can be inserted along the reel fastener axis 144 and through the pivot arm 128, such as discussed above. When the reel fastener 142 moves along the reel fastener axis 144 towards the pivot axis 122, the reel fastener 142 can frictionally engage an outer lip 302B of the outer flange 302. Thus, the reel fastener 142 can continue to move along the reel fastener axis 144 until the reel fastener 142 is tightened against the outer lip 302B in a direction that is orthogonal to the pivot axis 122 and orthogonal to the reel axis 310. Notably, the tightening of the reel fastener 142 against the outer lip 302B does not impede, inhibit, or otherwise alter the ability of the set of the inner flanges 304, 305 and the drum 306 from rotating about the reel axis 310. Conventional restraining devices may inhibit the ability for the cable or other linear elements to be wound or unwound from a cable reel. However, embodiments of the present disclosure allow for cable to be wound or unwound from the drum 306 while the reel chock 100 is restraining rotational motion of the set of the outer flanges 302, 303. These and other aspects can be seen with more detail in FIGS. 3C and 3D.

Figure 3C:
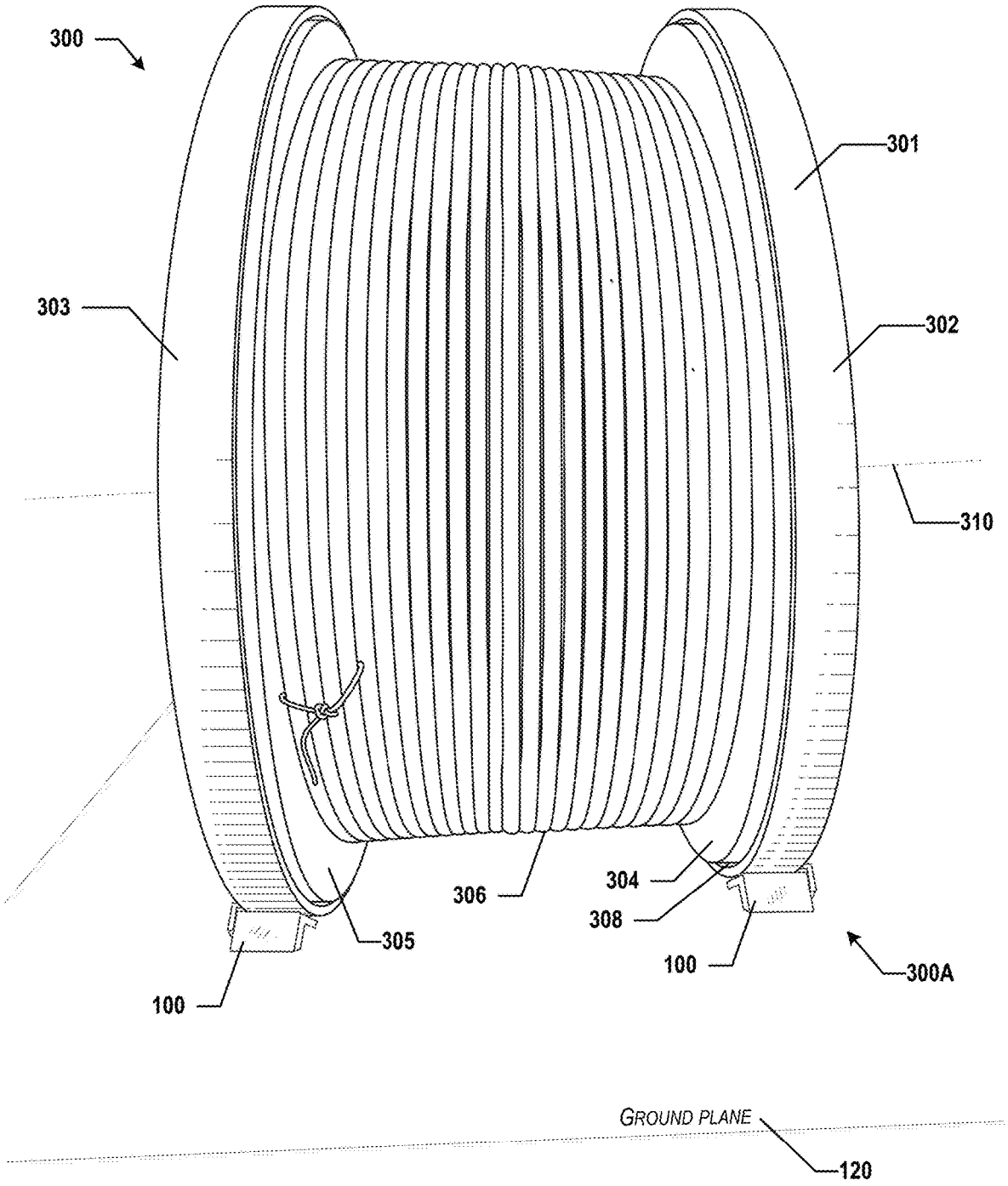
FIG. 3C illustrates a perspective view of the system shown in FIG. 3A with a cable reel held in place by a reel chock, according to illustrative embodiments of the present disclosure.
Figure 3D:
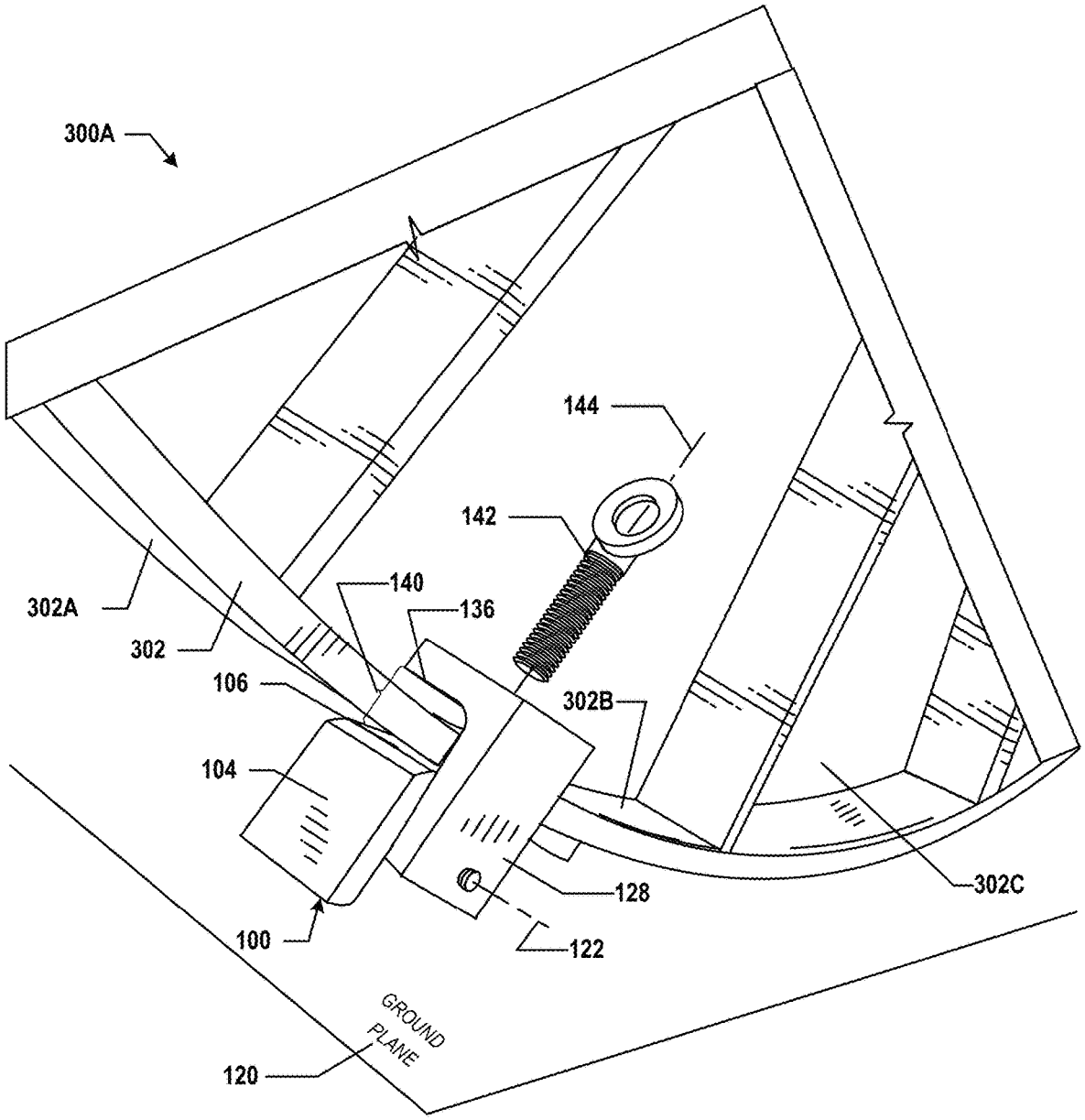
FIG. 3D is a perspective view illustrating aspects of a reel chock in an orientation relative to a cable reel shown in FIG. 3C, according to illustrative embodiments of the present disclosure.

FIGS. 3C and 3D illustrate perspective views and aspects of the system 300 with the cable reel 301 held in place by the reel chock 100. As shown in FIG. 3C, the cable reel 301 is located on the ground plane 120, which may be an uneven or otherwise unlevel surface. One of the reel chocks 100 is placed under the outer flange 302 and another one of the reel chocks 100 is placed under the outer flange 303. Each of the reel chocks 100 does not encapsulate or otherwise impede the rotation of the set of the inner flanges 304, 305, thereby allowing the drum 306 and the set of the inner flanges 304, 305 to rotate about the reel axis 310 while the outer flanges 302, 303 remain stationary due to the placement of the reel chocks 100. FIG. 3C also refers to an aspect view 300A showing details of the placement of the reel chock 100 so as to restrain the outer flange 302 while still allowing the inner flange 304 to rotate. As shown in FIG. 3D, the reel chock 100 is located underneath the outer flange 302 of the cable reel 301. The outer surface 302A of the outer flange 302 can be in contact with, and thus rest upon, a surface of the reel chock 100. As shown, the outer surface 302A of the outer flange 302 is in contact with the second outer surface 106 of the chock body 102. For the reel chock 100 that is restraining the outer flange 303, the first outer surface 104 of the chock body 102 would be in contact with the outer surface of the outer flange 303. As shown in FIG. 3D, the pivot arm 128 is rotated about the pivot axis 122 such that the gap 140 is created between the second outer surface 106 of the chock body 102 and the first inner surface 136 of the pivot arm 128. The outer lip 302B of the outer flange 302 is located within the gap 140. As such, the pivot axis 122 can be substantially parallel to the outer lip 302B of the outer flange 302. The reel fastener 142 can be inserted through the fastener passage 134 (not shown for clarity purposes) along the reel fastener axis 144. Once the reel fastener 142 is inserted, the end of the reel fastener 142 can extend into the gap 140 and come into contact with the outer lip 302B of the outer flange 302. The reel fastener 142 can be tightened via threads so as to clamp or otherwise restrain movement of the outer flange 302 via frictional engagement. The reel fastener 142 in combination with the chock body 102 can secure the outer flange 302 of the cable reel 301 in place without affecting the ability of the cable reel 301 to wind or unwind linear elements, such as cable, from the drum 306. This is because the reel chock 100 is configured so as not to impede the rotational movement of the drum 306 and/or the set of the inner flanges 304, 305. By this, the reel chock 100 can restrain or otherwise prevent at least a portion of the cable reel from rotational movement while continuing allow for installation or removal of cable from the cable reel 301.

Figure 4:
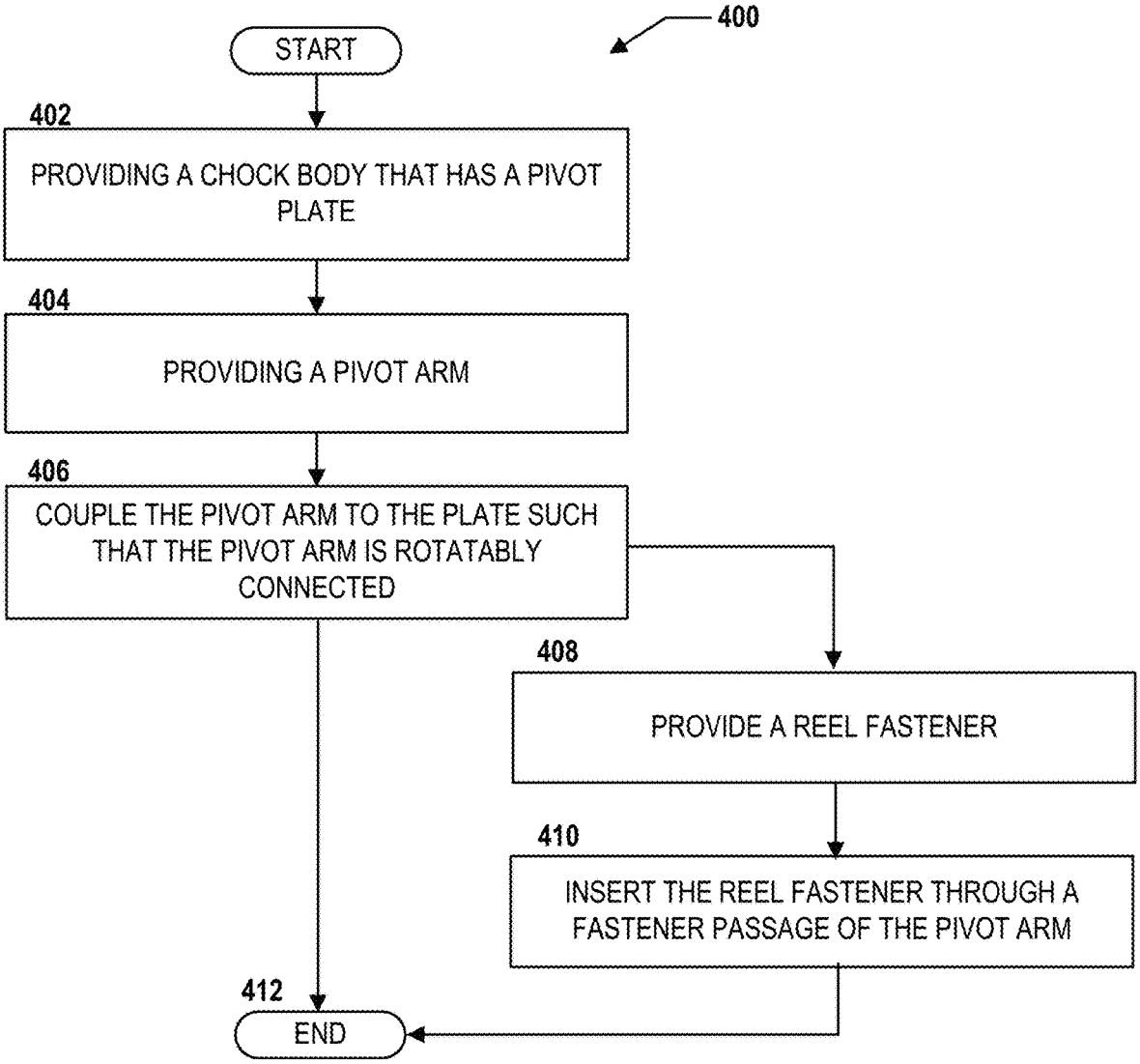
FIG. 4 is a flow diagram illustrating aspects of a method of assembling a reel chock, according to illustrative embodiments.

Turning now to FIG. 4, a method 400 for assembling a reel chock will be described, according to an illustrative embodiment. It should be understood that assembly of a reel chock can include assembly of one or more embodiments of the reel chocks discussed herein, including but not limited to the reel chock 100, the reel chock 100', the reel chock 200, and/or the reel chock 200'. It should be understood that the operations of the methods disclosed herein are not necessarily presented in any particular order and that performance of some or all of the operations in an alternative order(s) is possible and is contemplated. The operations have been presented in the demonstrated order for ease of description and illustration. Operations may be added, omitted, and/or performed simultaneously, without departing from the scope of the concepts and technologies disclosed herein. It also should be understood that the methods disclosed herein can be ended at any time and need not be performed in its entirety.

The method 400 begins at operation 402, which includes providing the chock body 102 that has a width that extends along the pivot axis 122. According to the embodiments, the chock body 102 can have the first inner surface 108 and the second inner surface 110, where each can extend parallel to the pivot axis 122. When the chock body 102 is provided, the pivot plate 124 may already be attached to the chock body 102 such that the pivot plate 124 is coupled to the first inner surface 108 and the second inner surface 110 of the chock body 102. In some embodiments, the chock body 102 is configured in the shape of an "L" and forms an angle 112 that is at least 90 degrees between the first inner surface 108 and the second inner surface 110.

From operation 402, the method 400 proceeds to operation 404, where the pivot arm 128 is provided. The pivot arm 128 can include the fastener portion 132 that allows the pivot arm 128 to form the shape of the letter "L". The pivot arm 128 can have the first inner surface 136 and the second inner surface 138, where the second inner surface 138 is placed next to, and substantially parallel with the pivot plate 124. The pivot arm 128 can include the connector passage 130. The assembly of the reel chock 100 can include aligning the connector passage 130 of the pivot arm 128 with the pivot plate opening 126, thereby centering the pivot arm 128 about the pivot axis 122.

From operation 404, the method 400 proceeds to operation 406, which includes coupling the pivot arm 128 to the pivot plate 124 such that the pivot arm 128 is rotatably connected about the pivot axis 122 to the pivot plate 124. For example, the pivot connector 146 can be provided and inserted through the connector passage 130 and the pivot plate opening 126. The pivot connector retainer 148 can be coupled, such as via threadable engagement, to the pivot connector 146 after the pivot connector 146 is inserted through the connector passage 130 and the pivot plate opening 126. Thus, the pivot connector 146 allows the pivot arm 128 to rotate about the pivot axis 122, while also restraining the pivot arm 128 from axially moving along the pivot axis 122 due to the pivot connector 146 being held in place with the pivot connector retainer 148. When the pivot arm 128 is secure via the pivot connector 146, the fastener portion 132 of the pivot arm 128 can at least partially extend over the chock body 102, such as either the first outer surface 104 or the second outer surface 106 of the chock body 102. Attachment of the pivot arm 128 to the pivot plate 124 can create the gap 140 between the chock body 102 and the fastener portion 132 of the pivot arm 128. The gap 140 can provide a distance that is large enough to receive an outer flange of a cable reel, such as either of the outer flanges 302, 303 of the cable reel 301. In some embodiments, from operation 406, the method 400 proceeds to operation 412, where the method 400 ends.

In other embodiments, from operation 406, the method 400 can proceed to operation 408, where the reel fastener 142 is provided. The reel fastener 142 can include an eyebolt or other bolt that can axially engage a flange of a cable reel, such as either of the outer flanges 302, 303 of the cable reel 301. The reel fastener 142 can provide frictional engagement along the reel fastener axis 144 that is orthogonal to the pivot axis 122.

From operation 408, the method 400 can proceed to operation 410, which includes inserting the reel fastener 142 through the fastener passage 134 of the pivot arm 128. The reel fastener 142 can threadably engage the fastener passage 134. In some embodiments, the reel fastener 142 can extend into the gap 140 between the chock body 102 and the fastener portion 132 in response to the reel fastener 142 being inserted towards the pivot axis 122. The reel fastener 142 can be configured to apply, once inserted, a normal force to the flange of a cable reel, thereby creating a frictional bond and restraining the outer flange 302, 303 in place while still permitting rotational movement of the inner flange 304.

In some embodiments, a magnet, such as the magnet 150, also can be provided. The magnet 150 can be placed within a magnet recess, such as the magnet recess 152. In some embodiments, the magnet fastener 156 is inserted through the magnet fastener passage 151 of the magnet 150 and through the magnet recess passage 157 of the magnet recess 152. In some embodiments, the magnet recess passage 157 can threadably engage with the magnet fastener 156. In other embodiments, the magnet fastener retainer 158 is provided and can threadably couple to an end of the magnet fastener 156 such that the magnet 150 is axially restrained along the magnet recess axis 154. In other embodiments, a chock body is provided that includes a support rib having a support rib opening, such as the chock body 202' that includes the support rib 260' having the support rib opening 262'. The magnet 250' can be provided and located adjacent to the support rib 260'. The magnet fastener 156 can be inserted through the magnet 250' and the support rib opening 262', where the magnet 250' can be axially restrained along the magnet axis 264' via the magnet fastener retainer 158 coupling to the magnet fastener 156. From operation 410, the method 400 proceeds to operation 412, where the method 400 ends.

The subject matter described above is provided by way of illustration only and should not be construed as limiting. Various modifications and changes may be made to the subject matter described herein without following the example embodiments and applications illustrated and described, and without departing from the true spirit and scope of the present invention, which is encompassed in the following claims.

What is claimed is:

1. A reel chock comprising:

a chock body that extends along a pivot axis, wherein the chock body has a first inner surface and a second inner surface, and wherein the first inner surface and the second inner surface meet to form an angle;

a pivot plate attached to the chock body, wherein the pivot plate is attached to the first inner surface and the second inner surface of the chock body;

a support rib attached to the chock body, wherein the support rib is transverse to the pivot axis, and wherein the support rib is offset from the pivot plate; and a pivot arm that is rotatably connected to the pivot plate such that the pivot arm rotates about the pivot axis, wherein the pivot arm comprises a fastener portion that extends at least partially over the chock body.

2. The reel chock of claim 1, wherein the pivot arm creates a gap between the chock body and the fastener portion when the pivot arm is rotatably connected to the pivot plate.

3. The reel chock of claim 2, further comprising a reel fastener that connects to the fastener portion, wherein the reel fastener extends along a reel fastener axis.

4. The reel chock of claim 3, wherein the fastener portion defines a fastener passage centered about the reel fastener axis, wherein the fastener passage allows the reel fastener to move along the reel fastener axis, and wherein the reel fastener axis is transverse to the pivot axis, and wherein the pivot plate is transverse to the pivot axis.

5. The reel chock of claim 4, wherein the reel fastener extends into the gap between the chock body and the fastener portion in response to the reel fastener moving towards the pivot axis.

6. The reel chock of claim 1, further comprising a magnet attached to the chock body.

7. The reel chock of claim 6, wherein the chock body comprises a magnet recess that extends below a surface of the chock body, wherein the magnet is located at least partially within the magnet recess.

8. The reel chock of claim 1, wherein the support rib defines a magnet axis, and wherein a magnet is attached to the support rib such that the magnet is centered about the magnet axis and is located at least flush with an edge of the chock body.

9. The reel chock of claim 1, wherein the support rib is attached to the first inner surface and the second inner surface of the chock body.

10. The reel chock of claim 1, wherein the angle formed by the first inner surface and the second inner surface is at least 90 degrees.

11. The reel chock of claim 10, wherein the support rib is attached to the first inner surface and the second inner surface of the chock body.

12. The reel chock of claim 1, wherein the pivot plate defines a pivot plate opening centered about the pivot axis, wherein the pivot arm defines a connector passage centered about the pivot axis, and wherein the reel chock further comprises a pivot connector that passes through the pivot plate opening and the connector passage.

13. A reel chock comprising:

a chock body that extends along a pivot axis, wherein the chock body has a first inner surface and a second inner surface;

a pivot plate attached to the chock body, wherein the pivot plate is transverse to the pivot axis, and wherein the pivot plate is attached to the first inner surface and the second inner surface of the chock body;

a support rib attached to the chock body, wherein the support rib is transverse to the pivot axis, and wherein the support rib is offset from the pivot plate;

a pivot arm that is rotatably connected to the pivot plate such that the pivot arm rotates about the pivot axis, wherein the pivot arm comprises a fastener portion that extends at least partially over the chock body, wherein the pivot arm creates a gap between the chock body and the fastener portion when the pivot arm is rotatably connected to the pivot plate; and a reel fastener that connects to the fastener portion, wherein the reel fastener extends along a reel fastener axis, wherein the reel fastener axis is transverse to the pivot axis, wherein the fastener portion defines a fastener passage centered about the reel fastener axis, and wherein the fastener passage allows the reel fastener to move along the reel fastener axis.

14. The reel chock of claim 13, wherein the support rib is attached to the first inner surface and the second inner surface of the chock body.

15. The reel chock of claim 13, wherein the pivot plate defines a pivot plate opening centered about the pivot axis, wherein the pivot arm defines a connector passage centered about the pivot axis, and wherein the reel chock further comprises a pivot connector that passes through the pivot plate opening and the connector passage.

16. The reel chock of claim 13, further comprising a magnet attached to the chock body.

17. The reel chock of claim 16, wherein the chock body comprises a magnet recess that extends below a surface of the chock body, and wherein the magnet is located at least partially within the magnet recess.

18. The reel chock of claim 13, wherein the support rib defines a magnet axis, and wherein a magnet is attached to the support rib such that the magnet is centered about the magnet axis and is located at least flush with an edge of the chock body.

19. The reel chock of claim 13, wherein the reel fastener extends into the gap between the chock body and the fastener portion in response to the reel fastener moving towards the pivot axis.

* * * * *